US007434444B2

(12) United States Patent
Browning

(10) Patent No.: US 7,434,444 B2
(45) Date of Patent: Oct. 14, 2008

(54) FRAME RAIL PULLING APPARATUS

(76) Inventor: Christopher L. Browning, 1044 N. Pegram St., Alexandria, VA (US) 22304

( * ) Notice: Subject to any disclaimer, the term of this patent is extended or adjusted under 35 U.S.C. 154(b) by 230 days.

(21) Appl. No.: 11/488,096

(22) Filed: Jul. 18, 2006

(65) Prior Publication Data

US 2008/0028820 A1 Feb. 7, 2008

(51) Int. Cl.
*B21C 1/00* (2006.01)

(52) U.S. Cl. ..... 72/705; 72/457; 72/392; 72/422

(58) Field of Classification Search ..... 72/308, 72/422, 457, 392, 705
See application file for complete search history.

(56) References Cited

U.S. PATENT DOCUMENTS

| | | | | | |
|---|---|---|---|---|---|
| 2,608,730 | A | * | 9/1952 | Killius | 269/257 |
| 3,241,352 | A | * | 3/1966 | Lincourt | 72/457 |
| 3,338,086 | A | | 8/1967 | Hunter | |
| 3,610,022 | A | * | 10/1971 | Lincourt | 72/457 |
| 3,696,653 | A | * | 10/1972 | Mojelski | 72/296 |
| 3,797,295 | A | * | 3/1974 | Sanchez | 72/308 |
| 3,992,921 | A | * | 11/1976 | Jarman | 72/457 |
| 4,037,456 | A | * | 7/1977 | Jarman | 72/325 |
| 4,106,325 | A | * | 8/1978 | Kuhn | 72/457 |
| 4,201,076 | A | * | 5/1980 | Jarman et al. | 72/392 |
| 4,296,626 | A | * | 10/1981 | Jarman et al. | 72/392 |
| 4,309,894 | A | * | 1/1982 | Connor | 72/457 |
| 4,348,884 | A | * | 9/1982 | Wivinis | 72/479 |
| 4,586,359 | A | * | 5/1986 | Parks | 72/302 |
| 4,748,842 | A | * | 6/1988 | Dingman | 72/457 |
| 4,848,130 | A | * | 7/1989 | Jimenez | 72/392 |
| 4,915,342 | A | * | 4/1990 | Nilsson | 248/500 |
| 4,916,793 | A | * | 4/1990 | Kuhn | 29/402.19 |
| 5,044,191 | A | * | 9/1991 | Combs | 72/422 |
| 5,095,729 | A | | 3/1992 | Bundy | |
| 5,156,037 | A | | 10/1992 | Bundy | |
| 5,233,858 | A | | 8/1993 | Bundy | |
| 5,335,533 | A | * | 8/1994 | Rehus | 72/422 |
| 5,415,023 | A | * | 5/1995 | Hinson | 72/457 |
| 6,122,953 | A | * | 9/2000 | Markarian | 72/457 |
| 6,453,715 | B1 | | 9/2002 | Venalainen | |
| 6,526,796 | B1 | | 3/2003 | Markarian | |
| 7,055,360 | B2 | * | 6/2006 | Hamerski et al. | 72/379.2 |

(Continued)

OTHER PUBLICATIONS

Mo-Clamp® Collision Repair Tool; Frame Rack Dyna-Mo Clamp; manufactured by Pull-It Corporation; www.moclamp.com.

*Primary Examiner*—Dmitry Suhol
(74) *Attorney, Agent, or Firm*—Breiner & Breiner, LLC

(57) ABSTRACT

A frame rail pulling apparatus for realigning a frame rail of a vehicle is disclosed. The apparatus includes a base, backing plate, side sway adapter, eye hook and fasteners. The base includes a platform with openings therein, cylinder, and side supports which distribute pressure equally from the cylinder to the openings in the platform. The backing plate has openings therein and is positioned adjacent to a first side of the base. The backing plate distributes pulling pressure over a greater area of the frame rail to prevent additional damage to the rail during realignment. The side sway adapter has a center opening and peripheral/end openings and is positioned adjacent to a second side of the base. The eye hook has a top portion and a shaft, wherein the shaft is positioned through the center opening of the side sway adapter and attaches to the base.

21 Claims, 5 Drawing Sheets

U.S. PATENT DOCUMENTS

2004/0226340 A1 11/2004 Dumdei
2005/0138986 A1* 6/2005 Hamerski et al. ..... 72/705
2005/0199035 A1 9/2005 Galanti

* cited by examiner

FRAME RAIL PULLING APPARATUS

FIELD OF INVENTION

The present invention relates to a frame rail pulling apparatus capable of pulling a frame rail of a vehicle in various directions without having to reposition the frame rail pulling apparatus. More particularly, the invention relates to a frame rail pulling apparatus comprising a base, a backing plate, a side sway adapter, an eye hook and fasteners, wherein the frame rail pulling apparatus attaches to a frame rail of a vehicle in order to realign the frame rail, such as after a collision.

BACKGROUND OF INVENTION

A vehicle includes various structural components and systems. One structural component is the frame of the vehicle. The frame is the backbone of the vehicle which provides its shape, structure, and strength. Various types of frames have been developed over the years. One type of frame construction is the unibody frame construction. The unibody frame was designed toward the safety of passengers, by enclosing them in a steel shell or cabin. Particularly, the unibody frame provides the structural strength of the vehicle and also a location and mounting points for other systems that make the total chassis of the vehicle. The unibody frame construction is preferably made of steel and designed so that the body of the vehicle is mounted on top.

The unibody frame construction is commonly used by automobile manufacturers because of its inherent ability to absorb energy during a collision. Since the unibody frame of a vehicle is designed to absorb energy during a collision, the frame of the vehicle is commonly damaged or bent during a collision. Under such circumstances, the frame will need to be repaired or straightened after a collision so that the vehicle will be operable and meet industry standards.

Many devices aid in straightening a frame rail of a vehicle after a collision. Such devices include Mo-Clamp® collision repair tools manufactured by Pull-It Corporation and are found at www.moclamp.com. The Mo-Clamp® collision repair tools include various clamps and pulling devices which are used in straightening frame rails of a vehicle, such as the Frame Rack Dyna-Mo Clamp.

U.S. Pat. Nos. 5,095,729 and 5,233,858 (the '858 patent being a continuation of the '729 patent) disclose an apparatus for correcting misaligned automobile rails which includes a face plate to which is joined a three-piece wedge assembly. The wedge assembly enables an area of contact to be established between the apparatus and the interior of a misaligned rail so that a pulling force applied to the apparatus is transferred to the rail through a broad area of contact thereby decreasing the chance of further damage to the rail during the repair process.

U.S. Patent Application Publication No. 2004/0226340 A1 discloses a clamp for straightening an automobile body or frame which includes two gripping members for attaching a pull chain in such a manner that the gripping members may be pulled in any direction without repositioning the gripping members. The gripping members are rectangular plates and may have one or more D-shaped loops extending therefrom.

U.S. Patent Application Publication No. 2005/0199035 A1 discloses a multi-directional pull tool having a fist-like cylindrical end section from which an elongated box-shaped section extends. The tool is designed to attach to the square or rectangular opening at the end of a damaged frame rail.

U.S. Pat. No. 6,526,796 B1 discloses a vehicle body frame puller attachment which includes a generally triangular main member having three sides with opposite side edges extending along each of the sides.

U.S. Pat. No. 6,453,715 B1 discloses a gripping device for straightening a car body whereby the gripping device is gripped and a straightening force is directed at the gripping device with the aid of a pull tool. The gripping device includes a frame clamping member having gripping claws which can be brought around an edge of the target of the vehicle being repaired, a rotatable fastening member pivotally mounted to the frame clamping member and a pull tool, such as a chain or equivalent, whereto the pull tool is fastened. The rotatable fastening member is arranged to be rotated relative to the frame clamping member of the gripping device.

U.S. Pat. No. 5,156,037 discloses a clamping apparatus for securing to and pulling upon an enlarged end of a longitudinal member of an automobile or vehicle chassis. The clamping apparatus has a pair of facing jaw members each having a bearing portion, a pulling portion, and an intermediate portion therebetween. The bearing portions each have a groove that substantially surrounds the periphery of the longitudinal member perpendicular to its longitudinal axis such that the clamping apparatus may not slide off the longitudinal member, while the bearing portions bear upon the enlarged end as an axial pulling force is transferred from the clamping apparatus to the automobile chassis.

U.S. Pat. No. 3,338,086 discloses a clamping device having a pair of complementary plates having opposed plane gripping surfaces at one end of each plate, one of the plates being a force plate with a force applying eye and the remaining plate being a jaw or gripping plate, movable relative to the force plate. The clamp further includes a flat semi-circular plate having threaded bored openings approximately equally spaced about a circular arc of the plate and an unthreaded bore located at a midpoint and offset from an edge formed by a diameter of the semi-circular plate. The clamp also includes a right-angle bracket which has slot openings and counter-sunk portions aligned with slot openings in the force plate.

These devices have various shortcomings which are addressed by the present invention.

OBJECTS AND SUMMARY OF THE INVENTION

The present invention relates to a frame rail pulling apparatus capable of pulling a frame rail of a vehicle in various directions without having to reposition the frame rail pulling apparatus. More particularly, the invention relates to a frame rail pulling apparatus comprising a base, a backing plate, a side sway adapter, an eye hook and fasteners, wherein the frame rail pulling apparatus attaches to a frame rail of a vehicle in order to realign the frame rail, such as after a collision.

The base of the frame rail pulling apparatus attaches directly to the outside of a frame rail, such as by fasteners such as screws, bolts, a combination thereof or the like. The base pulls the frame rail with equal pressure to all fastening points on the frame rail. The base has (1) a base platform with openings therein to enable the base to be attached to the frame rail, (2) a cylinder, and (3) side supports which distribute pressure equally from the cylinder to the openings in the base platform.

The backing plate attaches to the opposite side of the frame rail than the base. The backing plate distributes the pulling pressure over a greater area of the frame rail to prevent tearing or additional damage to the frame rail. The backing plate may be any suitable shape, but is preferably a half-circle or semi-circle which is shaped to fit around and/or adjacent to the frame rail of the vehicle. The backing plate has openings therein so that the backing plate can be attached to the frame rail and the base.

The side sway adapter has a center opening and various openings such as along the peripheral edge or an opening on each free end thereof. The side sway adapter is operatively positioned adjacent to the base on the opposite side to which the frame rail is attached. The peripheral or end openings of the side sway adapter enable a hook, chain or other device to be positioned therein so that the frame rail can be pulled in various directions, e.g., a lateral direction, during realignment of the frame rail.

The eye hook operatively positions the side sway adapter adjacent to the base and enables the frame rail to be pulled along its length. The eye hook comprises a top portion and a shaft. The shaft of the eye hook fits through the center opening of the side sway adapter and affixes to the base so that the side sway adapter is secured in place adjacent to the base and between the base and the top portion of the eye hook. The top portion of the eye hook has an opening therein which is sized and shaped to enable a hook, chain or other device to be positioned therein so that the frame rail can be pulled in a direction along its length.

Fasteners are operatively positioned in the frame rail pulling apparatus to secure the base and backing plate together and around the frame rail as detailed hereafter.

An object of the present invention is to provide a frame rail pulling apparatus which aids collision repair technicians in straightening and realigning frame rails of vehicles in an accurate and efficient manner.

Another object of the present invention is to provide a frame rail pulling apparatus which is designed specifically for the specific frame of a specific vehicle which will provide a more accurate and efficient alignment to the frame rail than a universal tool which can possibly create more damage to a unibody frame of a vehicle.

Another object of the invention is to provide a rail pulling apparatus having a backing plate which distributes the pulling pressure over a greater area of the frame rail to prevent tearing or additional damage to the frame rail during realignment.

Another object of the invention is to provide a lightweight and easy to use frame rail pulling apparatus for realigning frame rails of a vehicle.

Another object of the present invention is to provide a frame rail pulling apparatus which is inexpensive and easy to manufacture and use.

These objects of the invention will be apparent from the following description of the preferred embodiments of the invention and from the accompanying drawings.

BRIEF DESCRIPTION OF THE DRAWINGS

Referring to the drawings.

DETAILED DESCRIPTION OF THE PREFERRED EMBODIMENTS

Figure 1:
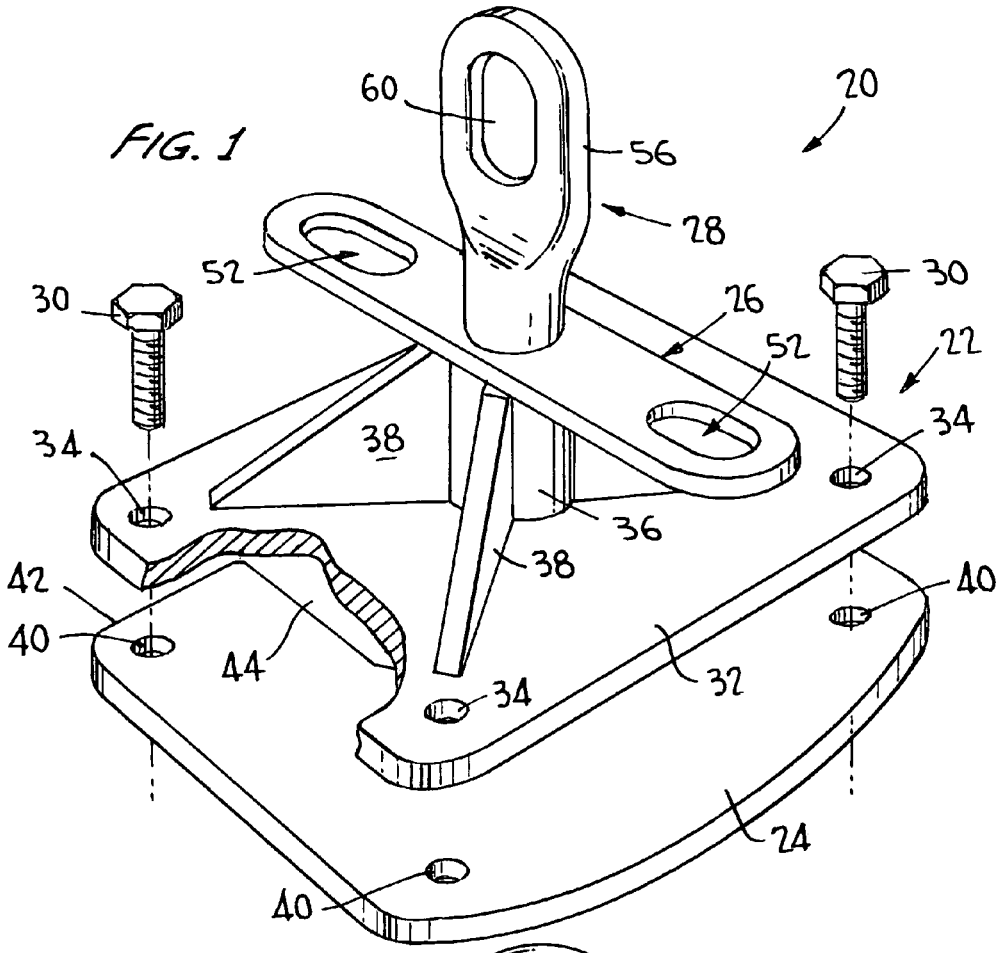
FIG. 1 is a perspective view of an embodiment of a frame rail pulling apparatus of the present invention.
Figure 2:
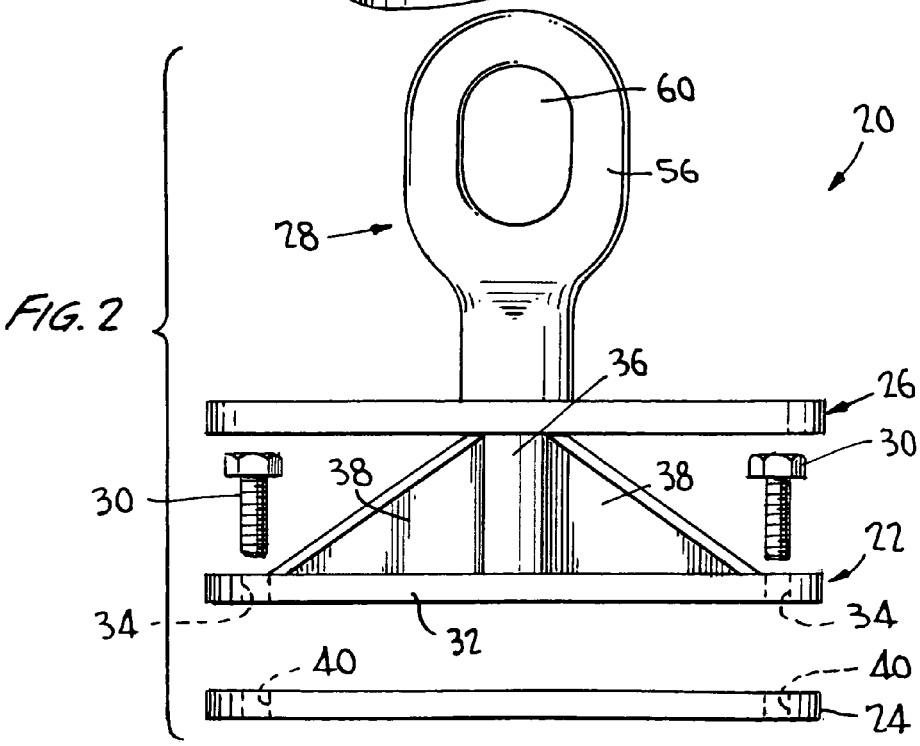
FIG. 2 is a side view of the frame rail pulling apparatus of FIG. 1.

Referring to FIGS. 1-10, the present invention relates to a frame rail pulling apparatus 20 capable of pulling a frame rail of a vehicle in various directions without having to reposition the frame rail pulling apparatus 20. As shown for example in FIGS. 1-3, a preferred embodiment of a frame rail pulling apparatus 20 comprises a base 22, a backing plate 24, a side sway adapter 26, an eye hook 28 and fasteners 30, wherein the frame rail pulling apparatus 20 attaches to a frame rail of a vehicle in order to aid in realigning the frame rail, such as after a collision.

The base 22 of the frame rail pulling apparatus 20 attaches directly to the outside of a frame rail, such as by fasteners 30 such as screws, bolts, a combination thereof or the like, as detailed hereafter. The base 22 pulls the frame rail with equal pressure to all fastening points on the frame rail. As shown for example in FIGS. 4 and 5, a preferred embodiment of the base 22 comprises (1) a base platform 32 with openings 34 therein to enable the base 22 to attach to the frame rail, (2) a cylinder 36, and (3) side supports 38 which distribute pressure substantially equally from the cylinder 36 to the openings 34 in the base platform 32.

Figure 4:
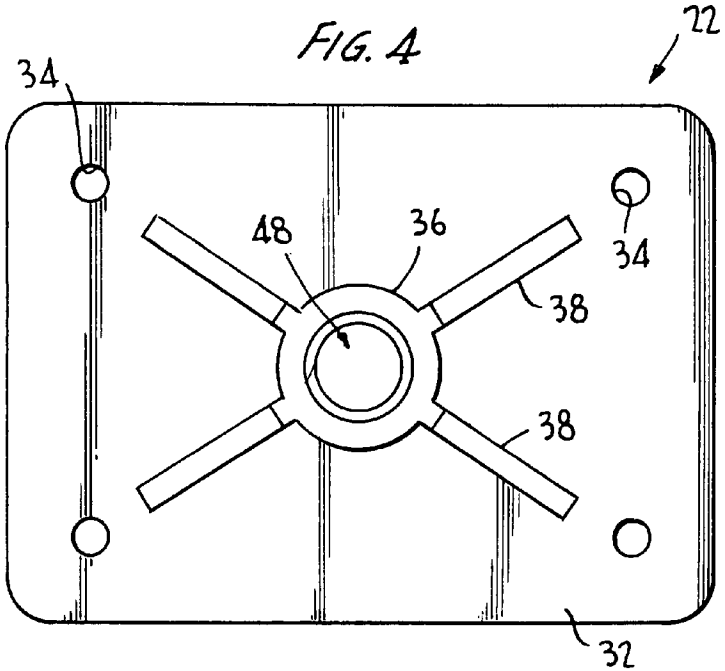
FIG. 4 is a top view of an embodiment of a base of the frame rail pulling apparatus of FIG. 1.
Figure 5:
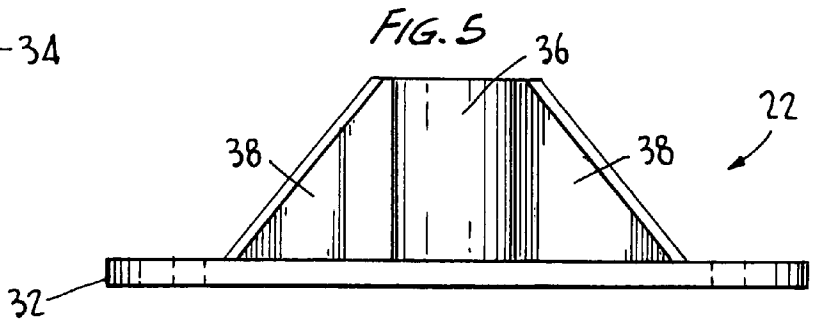
FIG. 5 is a side view of the base of FIG. 4.
Figure 3:
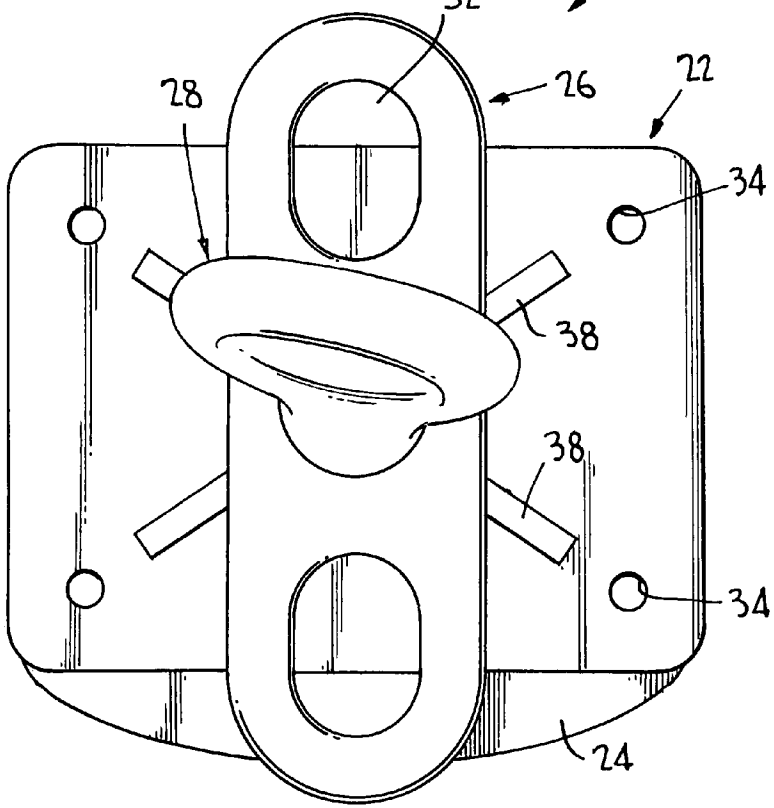
FIG. 3 is a top view of the frame rail pulling apparatus of FIG. 1.
Figure 6:
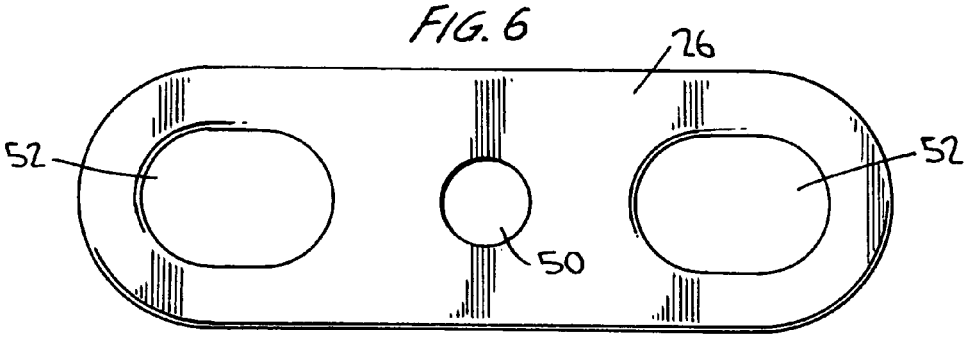
FIG. 6 is a top view of an embodiment of a side sway adapter of the frame rail pulling apparatus of FIG. 1.
Figure 7A:
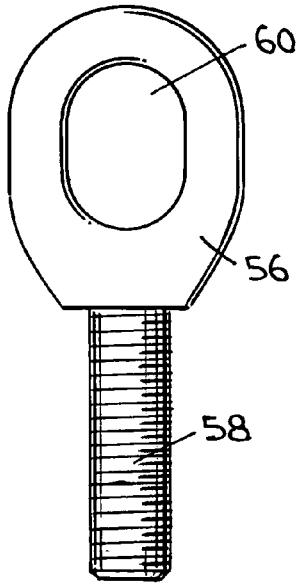
FIG. 7*a* is a side view of one embodiment of an eye hook of the frame rail pulling apparatus of FIG. 1.
Figure 7B:
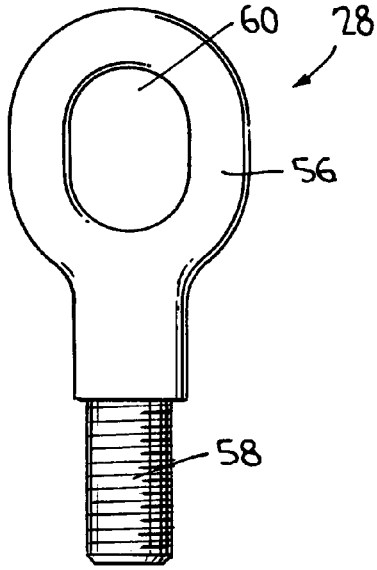
FIG. 7*b* is a side view of a second embodiment of an eye hook of the frame rail pulling apparatus of FIG. 1.
Figure 8:
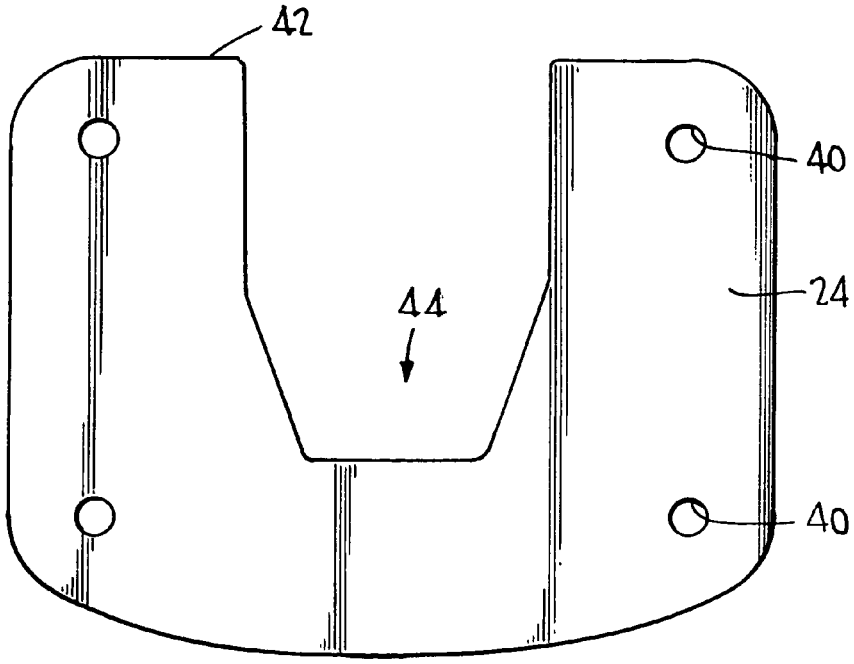
FIG. 8 is a top view of an embodiment of a backing plate of the frame rail pulling apparatus of FIG. 1.

As shown for example in FIGS. 4 and 5, the base platform 32 is preferably square shaped. However, the base platform 32 may be any suitable shape, including, but not limited to, rectangular, circular or oval shaped. In a preferred embodiment, the base platform 32 is flat. The openings 34 in the base platform 32 are positioned in predetermined locations depending on the type of vehicle that the frame rail pulling apparatus 20 is being used to realign. In a preferred embodiment, the plurality of openings 34 in the base platform 32 are operatively positioned therein along the perimeter thereof. For example, in a preferred embodiment having a square or rectangular shaped base platform 32, an opening 34 is preferably operatively positioned in each of the corners of the base platform 32, such as shown for example in FIG. 4. However, the openings 34 in the base platform 32 may be operatively positioned in any suitable location in the base platform 32. The openings 34 in the base platform 32 enable the base platform 32 to attach directly to a frame rail as detailed hereafter.

The cylinder 36 of the base 22 is preferably operatively centered on the base platform 32 and substantially perpendicular to the plane of the base platform 32. The cylinder 36 has an opening 48 therein and enables the eye hook 28 to attach to the base 22. In a preferred embodiment, the inside wall 46 of the opening 48 of the cylinder 36 has screw threadings.

The side supports 38 of the base 22 are operatively positioned substantially perpendicular to the base platform 32 and attach to the cylinder 36. In a preferred embodiment, the side supports 38 are operatively positioned between and in alignment with the openings 34 in the base platform 32 and the cylinder 36, such as shown for example in FIG. 4. The side supports 38 distribute the pressure/pulling force applied to the frame rail pulling apparatus 20 substantially equally from the cylinder 36 to the fastening points at the openings 34 in the base platform 32.

The base 22 may be made of any suitable material including, but not limited to, plastic, wood, metal, a combination thereof or the like.

Figure 9:
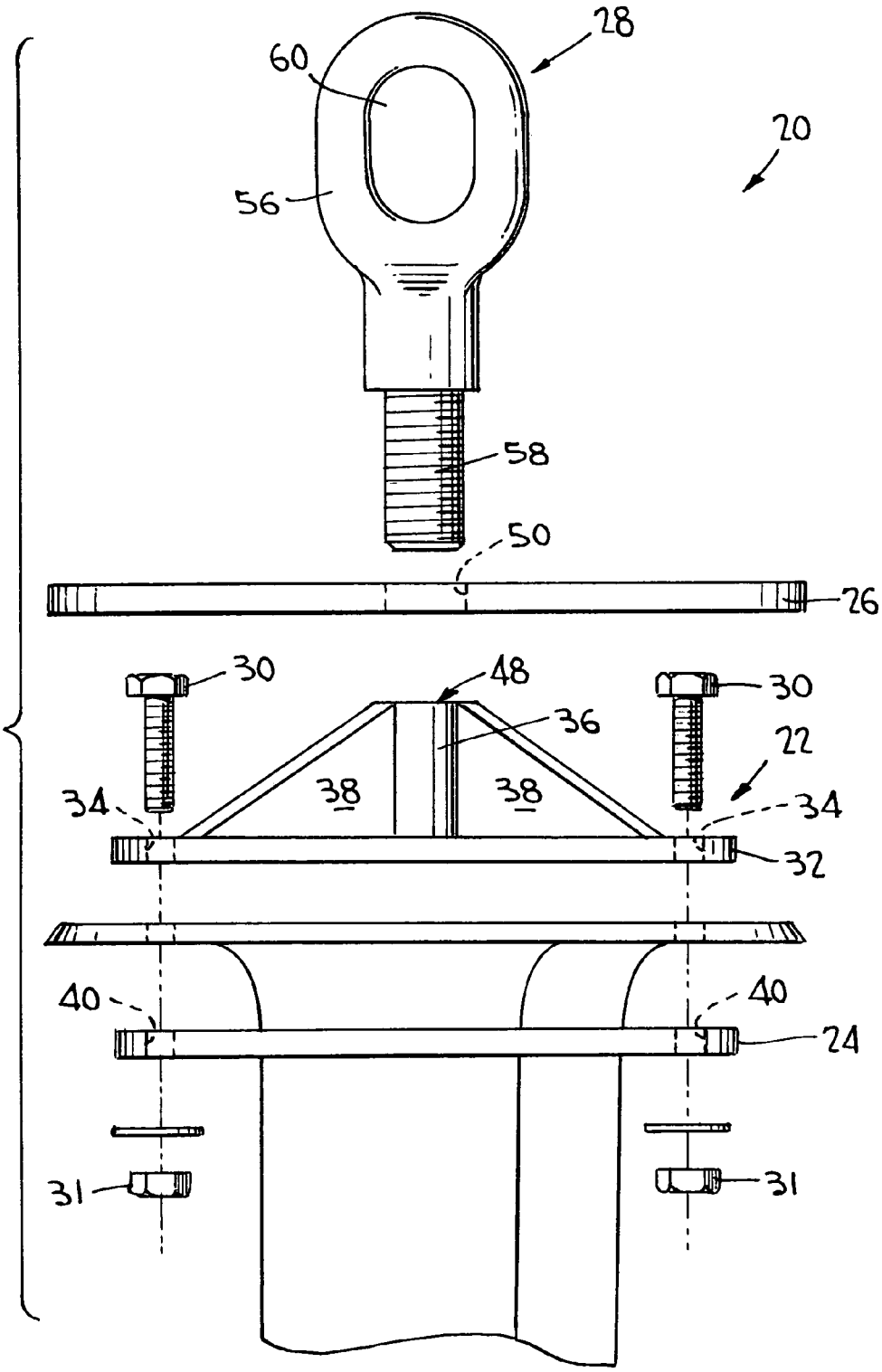
FIG. 9 is an exploded view of an embodiment of the frame rail pulling apparatus of FIG. 1.
Figure 10:
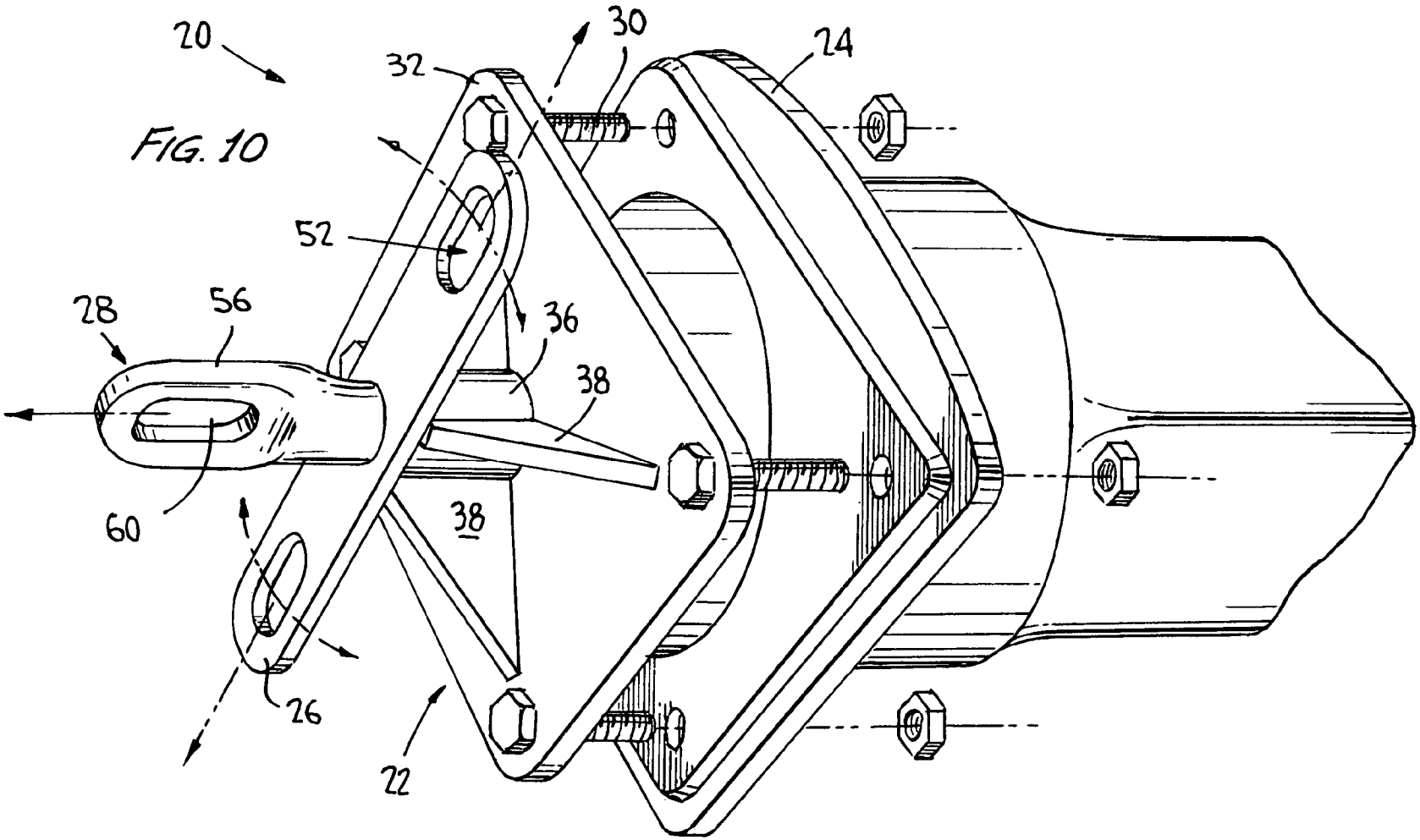
FIG. 10 is a perspective view of the frame rail pulling apparatus of FIG. 1 in a field of use with a frame rail.

The backing plate 24 of the frame rail pulling apparatus 20 attaches to the opposite side of the frame rail than the side to which the base 22 attaches, such as shown for example in FIGS. 9 and 10. The backing plate 24 distributes the pulling pressure/force exerted on the frame rail pulling apparatus 20 and on the frame rail over a greater area of the frame rail to prevent tearing or additional damage to the frame rail.

The backing plate 24 may be any suitable shape, but the shape of the backing plate 24 preferably depends on the shape of the frame rail for which the frame rail pulling apparatus 20 is to be used in conjunction with. In a preferred embodiment, the backing plate 24 is a half-circle or semi-circular in shape and is shaped to fit around or adjacent to the frame rail of a specific vehicle. As shown for example in FIG. 8, the backing plate 24 preferably comprises a plurality of openings 40 therein to enable the backing plate 24 to attach to the frame rail and to the base 22. The openings 40 in the backing plate 24 are operatively positioned in accordance with the positioning of the openings 34 in the base 22 such that the openings 40 in the backing plate 24 and the openings 34 in the base 22 are in alignment when the base 22 and the backing plate 24 are in the proper position around a frame rail.

A first side 42 of the backing plate 24 preferably has a cut-out portion 44 which is preferably shaped to fit in conjunction with the shape of the frame rail with which it is to be used so that the backing plate 24 will slide over and/or around the frame rail and fit adjacent thereto.

The backing plate 24 may be made of any suitable material including, but not limited to, plastic, wood, metal, a combination thereof or the like.

The base 22 and the backing plate 24 may attach to the frame rail by any suitable fasteners 30 including, but not limited to, screws, bolts, or the like. In a preferred embodiment, such as shown for example in FIG. 9, when the base 22 and the backing plate 24 are in position around and adjacent to the frame rail, a fastener 30 such as a screw, bolt or the like, is inserted through each of the openings 34 in the base 22, through the corresponding opening in the frame rail, and through the corresponding opening 40 in the backing plate 24. A securing member 31, such as a nut, attaches to the fastener 30, e.g., screw or bolt, to secure the backing plate 24 and the base 22 in position around and adjacent to the frame rail.

The side sway adapter 26 of the frame rail pulling apparatus 20 may be any suitable shape. In a preferred embodiment, the side sway adapter 26 is oval or oblong in shape, such as shown for example in FIG. 6.

The side sway adapter 26 is operatively positioned adjacent to the base 22 on the opposite side to which the frame rail is attached. As shown for example in FIG. 6, the side sway adapter 26 preferably has a center opening 50 and various openings 52 such as along the peripheral edge or an opening on each free end of the side sway adapter 26.

The center opening 50 of the side sway adapter 26 enables the side sway adapter 26 to be aligned with the base 22. The center opening 50 of the side sway adapter 26 is of a size sufficient to enable a shaft 58 of the eye hook 28 to be inserted therethrough and into the opening 48 in the cylinder 36 of the base 22 as detailed hereafter.

The peripheral or end openings 52 of the side sway adapter 26 enable a hook, chain or other device to be positioned or inserted therein in order to pull the side sway adapter 26 and thereby pull the frame rail in at least one of various directions, including a lateral direction such as to the left, right, up, and/or down.

The peripheral or end openings 52 of the side sway adapter 26 may be any suitable size and shape which is sufficient to enable the hook, chain or other device to be inserted therethrough. In a preferred embodiment, the peripheral or end openings 52 are preferably oval or egg shaped which enables the hook, chain or other device to be easily inserted through the peripheral or end opening 52 so that the side sway adapter 26 may be pulled, thereby pulling the frame rail in the same direction to place the frame rail in substantial alignment in accordance with factory specifications for the vehicle.

The side sway adapter 26 may be made of any suitable material including, but not limited to, plastic, wood, metal, a combination thereof or the like.

The eye hook 28 of the frame rail pulling apparatus 20 operatively positions the side sway adapter 26 adjacent to the base 22 and enables the frame rail to be pulled along its length. As shown for example in FIGS. 7*a* and 7*b*, the eye hook 28 preferably comprises a top portion 56 with an opening 60 therein and a shaft 58. The shaft 58 of the eye hook 28 fits through the center opening 50 of the side sway adapter 26 and affixes to the base 22 so that the side sway adapter 26 is adjacent to and secured to the base 22. In a preferred embodiment, the shaft 58 of the eye hook 28 is secured in the opening 48 of the cylinder 36 of the base 22, thereby securing the base 22, the side sway adapter 26, and the eye hook 28 together.

The opening 60 in the top portion 56 of the eye hook 28 may be any suitable shape. In a preferred embodiment, the opening 60 in the eye hook 56 is preferably oval or egg shaped. The opening 60 of the eye hook is of a size sufficient to allow a hook, chain or other device to be attached therethrough so that the eye hook 56 may be pulled, thereby pulling the frame rail along its length.

In a preferred embodiment, the shaft 58 of the eye hook 28 is preferably threaded in order to enable the eye hook 28 to be attached in the opening 48 of the cylinder 36 of the base which is also preferably threaded. However, the shaft 58 of the eye hook 28 may be any suitable construction.

The eye hook 28 may be made of any suitable material including, but not limited to, plastic, wood, metal, a combination thereof or the like.

Fasteners 30 secure the base 22 and backing plate 24 together and to the frame rail as detailed above. The fasteners 30 may be any suitable fasteners including, but not limited to, screws, bolts, a combination thereof or the like.

As detailed above, the frame rail pulling apparatus 20 of the present invention aids in pulling and/or re-aligning unibody frame rails of a vehicle in various directions including, along its length, up, down, left and/or right without having to reposition the frame rail pulling apparatus 20. As such, the unibody frame of a vehicle can be aligned to factory specifications after a collision to ensure the proper alignment of the frame of the vehicle and of other components throughout the vehicle.

In order to assemble the frame rail pulling apparatus 20 to a frame rail, the base 26 is positioned on a first end, i.e., an outer end, of a frame rail and the backing plate 24 is positioned on the inside of the end of the frame rail as detailed above. A fastener 30 is inserted through each opening 34 in the base 22, the corresponding opening in the frame rail, and the corresponding opening 40 in the backing plate 24. A securing member 31, e.g., nut, attaches to the free end of the fastener 30, e.g., screw or bolt, to hold these components together on the frame rail. When the base 22 and the backing plate 24 are attached to the frame rail as detailed above, the side sway adapter 26 is then positioned on the base 22 such that the center opening 50 of the side sway adapter 26 is in substantial alignment with the opening 48 in the cylinder 36 of the base 22. Once the side sway adapter 26 is in place, the eye hook 28 is inserted through the center opening 50 of the side sway adapter 26 into the opening 48 in the cylinder 36 of the base 22. The eye hook 28 holds the side sway adapter 26 and the base 22 together.

While a preferred order and manner of assembling the frame rail pulling apparatus 20 has been detailed above, the components of the frame rail pulling apparatus 20 may be assembled in any other suitable order and manner.

While the components of the frame rail pulling apparatus 20 are preferably separate components secured together as detailed above, any two or more components may be integral for ease of use, manufacturing or the like and fall within the scope of the invention.

As detailed above, the frame rail may be realigned by exerting a force, e.g., pulling pressure, on the side sway adapter 26 or the eye hook 28. This pulling pressure may be exerted on the side sway adapter 26 and/or the eye hook 28 singularly or in combination in order to provide a predetermined pulling pressure in at least one predetermined direction to provide the proper realignment to the frame rail.

In a preferred embodiment, the frame rail pulling apparatus is designed in size and shape to work in conjunction with the specific frame rail construction of a specific vehicle.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art to form a part of the present invention and are embraced by the appended claims.

It is claimed:

1. An apparatus for attaching to a frame rail of a vehicle structure and aiding in realignment thereof, said apparatus comprising:

(a) a base having a plurality of openings operatively positioned therein, a first side and a second side;

(b) a backing plate having a plurality of openings operatively positioned therein, said backing plate being operatively positioned substantially adjacent to said first side of said base;

(c) a side sway adapter having a center opening and at least one peripheral opening along a periphery thereof or at least one end opening along an end thereof, said side sway adapter being operatively positioned adjacent to said second side of said base;

(d) an eye hook having a top portion with an opening therein and a shaft, wherein said shaft passes through said center opening of said side sway adapter and is secured to said base; and (e) a plurality of fasteners, wherein each of said plurality of fasteners passes through one of said plurality of openings in said base and through a corresponding opening of said plurality of openings in said backing plate, wherein said apparatus is constructed and arranged for attachment to a frame rail of a vehicle structure, wherein a portion of said frame rail of said vehicle structure is to be secured between said base and said backing plate.

2. The apparatus of claim 1, wherein said base comprises:

a base platform having a first side and a second side;

a cylinder; and a plurality of side supports, wherein said plurality of openings of said base are operatively positioned in said base platform.

3. The apparatus of claim 2, wherein said cylinder is substantially centered on said base platform.

4. The apparatus of claim 2, wherein each of said plurality of side supports attaches to said cylinder and to said base platform and is substantially perpendicular to said base platform.

5. The apparatus of claim 2, wherein each of said plurality of side supports is operatively positioned in alignment between one of said openings in said base platform and said cylinder.

6. The apparatus of claim 2, wherein said cylinder has an opening therein.

7. The apparatus of claim 6, wherein said opening in said cylinder is a threaded opening.

8. The apparatus of claim 7, wherein said shaft of said eye hook is threaded.

9. The apparatus of claim 8, wherein said threaded shaft of said eye hook is secured within said threaded opening of said cylinder.

10. The apparatus of claim 2, wherein said shaft of said eye hook is secured within said cylinder of said base.

11. The apparatus of claim 1, wherein said shaft of said eye hook is threaded.

12. The apparatus of claim 1, wherein said base is made of plastic, metal, wood, and/or a combination thereof.

13. The apparatus of claim 1, wherein said backing plate is made of plastic, metal, wood, and/or a combination thereof.

14. The apparatus of claim 1, wherein said side sway adapter is made of plastic, metal, wood, and/or a combination thereof.

15. The apparatus of claim 1, wherein said eye hook is made of plastic, metal, wood, and/or a combination thereof.

16. The apparatus of claim 1, wherein said backing plate has a cut-out portion in a first side of said backing plate, wherein said cut-out portion is of size and shape which is complimentary to and corresponds to a size and shape of a frame rail.

17. The apparatus of claim 1, wherein said backing plate is a semi-circular shape or a half-circle shape.

18. The apparatus of claim 2, wherein said base platform is a square or a rectangle.

19. The apparatus of claim 2, wherein said base has four openings in said base platform and four side supports, wherein each side support attaches to said cylinder and is in alignment with one of said four openings in said base platform.

20. The apparatus of claim 1, wherein said side sway adapter is an oval shape or an oblong shape.

21. A method for realigning or straightening a frame rail of a vehicle, said method comprising:

providing an apparatus for attaching to a frame rail of a vehicle, wherein providing said apparatus comprises:

providing a base having a plurality of openings operatively positioned therein, a first side and a second side;

providing a backing plate having a plurality of openings operatively positioned therein, said backing plate being operatively positioned substantially adjacent to said first side of said base;

providing a side sway adapter having a center opening and at least one peripheral opening along a periphery thereof or at least one end opening along an end thereof, said side sway adapter being operatively positioned adjacent to said second side of said base;

providing an eye hook having a top portion with an opening therein and a shaft, wherein said shaft passes through said center opening of said side sway adapter and is secured to said base; and providing a plurality of fasteners, wherein each of said plurality of fasteners passes through one of said plurality of openings in said base and through a corresponding opening of said plurality of openings in said backing plate, wherein said apparatus is constructed and arranged for attachment to said frame rail of said vehicle, wherein a portion of said frame rail of said vehicle is to be secured between said base and said backing plate.

* * * * *